US006702430B2

(12) United States Patent
Blom et al.

(10) Patent No.: US 6,702,430 B2
(45) Date of Patent: Mar. 9, 2004

(54) ACTUATING DEVICE FOR A MULTI-NOZZLE INK JET PRINTHEAD

(75) Inventors: Franciscus Richard Blom, Mierlo (NL); André Jozef Christiaan Gerardus Erren, Afferden (NL); Hans Reinten, Velden (NL)

(73) Assignee: OcéTechnologies B.V., Venlo (NL)

( * ) Notice: Subject to any disclaimer, the term of this patent is extended or adjusted under 35 U.S.C. 154(b) by 0 days.

(21) Appl. No.: 10/235,509

(22) Filed: Sep. 6, 2002

(65) Prior Publication Data

US 2003/0048318 A1 Mar. 13, 2003

(30) Foreign Application Priority Data

Sep. 7, 2001 (EP) ..... 01203564

(51) Int. Cl.[7] ..... B41J 2/045
(52) U.S. Cl. ..... 347/68; 347/71
(58) Field of Search ..... 347/68, 70, 71

(56) References Cited

U.S. PATENT DOCUMENTS 4,381,515 A 4/1983 Bain ..... 347/12
5,818,482 A * 10/1998 Ohta et al. ..... 347/70
6,161,925 A * 12/2000 Reinten et al. ..... 347/70
6,513,917 B1 * 2/2003 Matsuda et al. ..... 347/70

FOREIGN PATENT DOCUMENTS

EP 0 820 869 A 1/1998
JP 03258550 11/1991

* cited by examiner

*Primary Examiner*—Thinh Nguyen
(74) *Attorney, Agent, or Firm*—Birch, Stewart, Kolasch & Birch, LLP

(57) ABSTRACT

An actuating device for a multi-nozzle ink jet printhead, which includes a linear array of electromechanical transducers some of which are configured as actuator fingers associated with the nozzles of the printhead while others are configured as support fingers disposed between the actuator fingers, wherein each transducer has a first and a second electrode and is adapted to expand and contract in accordance with a voltage applied between the first and second electrodes, wherein the totality of the transducers consists of at least one group which includes a plurality of actuator fingers and a plurality of support fingers, and control circuit are associated with each group for applying a voltage that depends on the number of active actuator fingers in this group, to the first electrodes of all support fingers of the group.

5 Claims, 2 Drawing Sheets

ACTUATING DEVICE FOR A MULTI-NOZZLE INK JET PRINTHEAD

BACKGROUND OF THE INVENTION

The present invention relates to an actuating device for a multi-nozzle ink jet printhead comprising a linear array of electromechanical transducers some of which are configured as actuator fingers associated with the nozzles of the printhead while others are configured as support fingers intervening between the actuator fingers, wherein each transducer has a first and a second electrode and is adapted to expand and contract in accordance with a voltage applied between the first and second electrodes.

An actuating device of this type has been disclosed in EP-B-0 820 869. The electromechanical transducers are formed by piezoelectric elements and are disposed on one side of a channel plate in which a plurality of parallel ink channels are formed each of which lead to a nozzle of the printhead. Each of the transducers serving as an actuator is disposed adjacent to one of the ink channels so that, by contraction and expansion of the actuator finger, ink is drawn into the ink channel from an ink reservoir and is then expelled from the associated nozzle. The support fingers intervening between the actuator fingers are connected to dam portions separating the individual ink channels. The ends of the support fingers and actuator fingers opposite to the channel plate are interconnected by a backing plate which, together with the support fingers, has the purpose of absorbing the reaction forces of the contraction and expansion strokes of the actuator fingers.

While an alternating arrangement of actuator fingers and support fingers is possible, the cited document proposes an arrangement with one support finger for two actuator fingers. In a preferred embodiment disclosed in this publication, the support fingers are passive. However, it is mentioned that these support fingers may be formed also by piezoelectric transducers which could then be controlled actively in order to compensate for the reaction forces of the actuator fingers. However, an electronic control system permitting the control of each of the active support fingers individually would considerably add to the complexity of the system.

On the other hand, when passive support fingers are used, the backing plate is caused to vibrate, especially when a large number of nozzles of the printhead are activated simultaneously, and this leads to the production of noise, at a frequency in the order of 10 kHZ for example, to an increased power consumption and to the cross-talk phenomena causing the volumes and velocities of the ink droplets expelled from the various nozzles to become non-uniform, It is generally known to actively compensate for the cross-talk phenomena by modifying the control signals applied to the actuator fingers in accordance with the activation or non-activation state of the neighboring actuators, for example by means of a resistor network, as described in U.S. Pat. No. 4,381,515.

SUMMARY OF THE INVENTION

It is an object of the present invention to provide an actuating device of the type indicated in the opening paragraph of the present description, in which active control of the support fingers can be achieved by simplified control means. According to the present invention, this object is achieved by the feature that the totality of the linear array of electromechanical transducers consists of at least one group which includes a plurality of actuator fingers and a plurality of support fingers, and control means that are associated with each group for applying a voltage, depending on the number of active actuator fingers in this group, to the first electrodes of all support fingers in the group.

It has been found that since the vibration of the backing plate caused by the reaction forces of the actuator fingers becomes significant only when a large number of actuator fingers is activated simultaneously, the disturbing effect of this vibration can largely be eliminated when the actuator and support fingers are grouped and all support fingers belonging to the same group are controlled by one and the same control signal, which depends on the number of active actuator fingers in this group. As a result, the number of control signals that have to be generated in real-time corresponds only to the comparatively small number of groups and not to the comparatively large number of individual support fingers, so that the control means can be considerably simplified.

In an extreme situation, the totality of the transducers may form only a single group, so that not more than one control signal is required for all actuator fingers.

In a particularly attractive embodiment, the first electrodes of all actuator fingers and all support fingers belonging to the same group are interconnected with each other and are held on a floating potential. Then, electrically, the actuator fingers and the support fingers form a network of impedance elements with the actuator fingers connected in parallel with each other and the support fingers also connected in parallel with each other but with the actuator fingers and the support fingers connected in series, with the floating potential between them. As a result, the support fingers are actively controlled by the voltage drop between the common potential and their respective second electrode, and the common potential will automatically depend on the number of active actuator fingers in the group.

The impedances (i.e. capacitances in case of piezoelectric elements) of the support fingers in relation to the impedances of the actuator fingers may be adjusted in order to achieve an optimal compensation of the reaction forces.

If Ohmic resistances are neglected, the first electrodes of all support fingers within a group are maintained at exactly the same voltage. However, if impedances in the lines interconnecting the first electrodes of the various support fingers are considered, the voltages applied to the individual support fingers may deviate from one another. If only a single actuator finger of the group is activated, then the voltages applied to the first electrodes of the support fingers will decay with increasing distance from the activated actuator finger. On the other hand, the deflection or bending stress of the backing plate caused by the reaction force of the active actuator finger will also decay with increasing distance from this actuator finger. As a result, it is possible to adjust the impedances between the adjacent first electrodes of the transducers so as to map the decay of the stresses in the backing plate. In this way, it is even possible to attenuate a local deflection of the backing plate, although the support fingers are not controlled individually.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
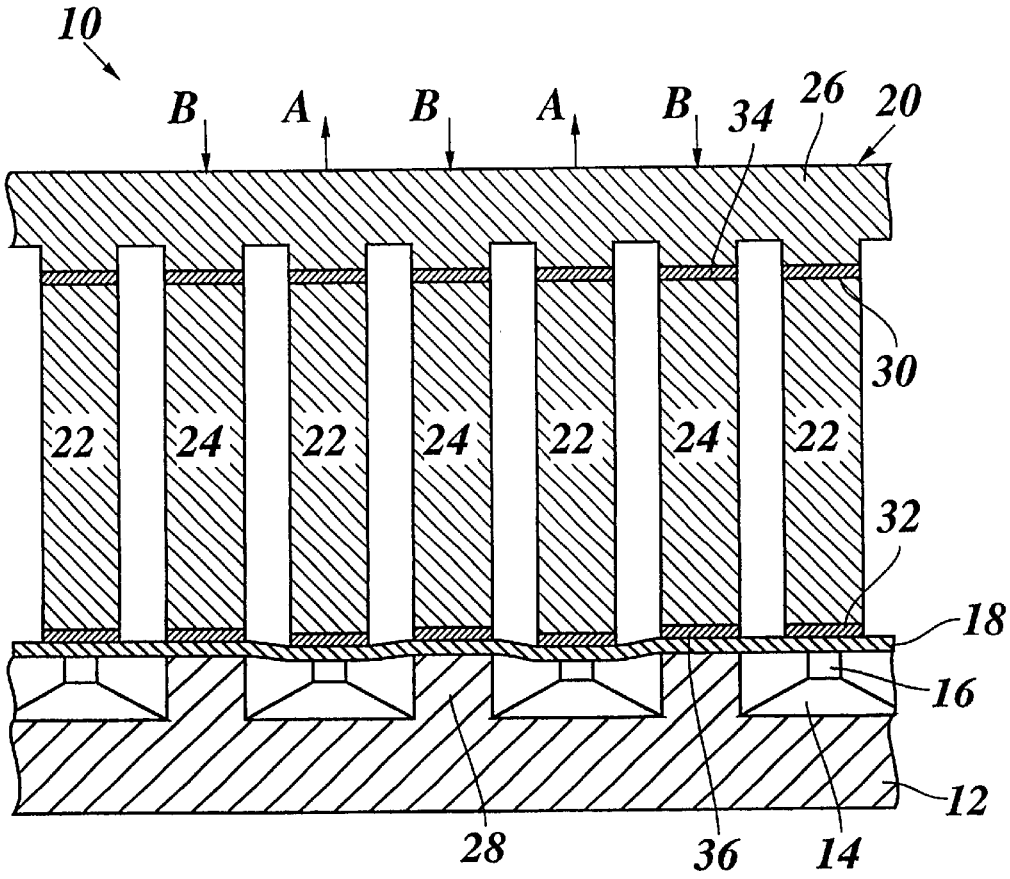
FIG. 1 is a schematic cross-sectional view of an actuating device of a multi-nozzle ink jet printhead.

As is shown in FIG. 1, a multi-nozzle ink jet printhead 10 comprises a channel plate 12 with a large number of parallel ink channels 14 (shown in cross-section), each of which leads to a nozzle 16 of the printhead. The ink channels 14 are covered by a flexible plate 18 fixed to the top surface of the channel plate 12, and a piezoelectric actuating device 20 is fixed on the top surface of the flexible plate 18.

The actuating device 20 has a comb-structure of piezoelectric material forming a plurality of electromechanical transducers 22, 24 interconnected by a backing plate 26 at their ends remote from the channel plate 12. The transducers 22 serve as actuator fingers and are each disposed right above one of the ink channels 14, whereas the transducers 24 serve as support fingers and are disposed above dam portions 28 of the channel plate. The backing plate 26 is fixedly connected to the assembly of the flexible plate 18 and the channel plate 12 through the support fingers 24.

Each actuator finger 22 has a first electrode 30 and a second electrode 32, and the piezoelectric material between them is polarized so that, when a voltage is applied between the electrodes 30, 32, the actuator finger 22 expands or contracts, depending on the polarity of the voltage. Although only one first electrode 30 and one second electrode 32 are shown in FIG. 1, it is understood that the actuator finger 22 may include a plurality of internal electrodes serving alternatingly as first electrode and second electrode, as is well known in the art.

The support fingers 24 have the same electrode structure as the actuator fingers 22 and, thus, each includes a first electrode 34 and a second electrode 36.

Figure 2:
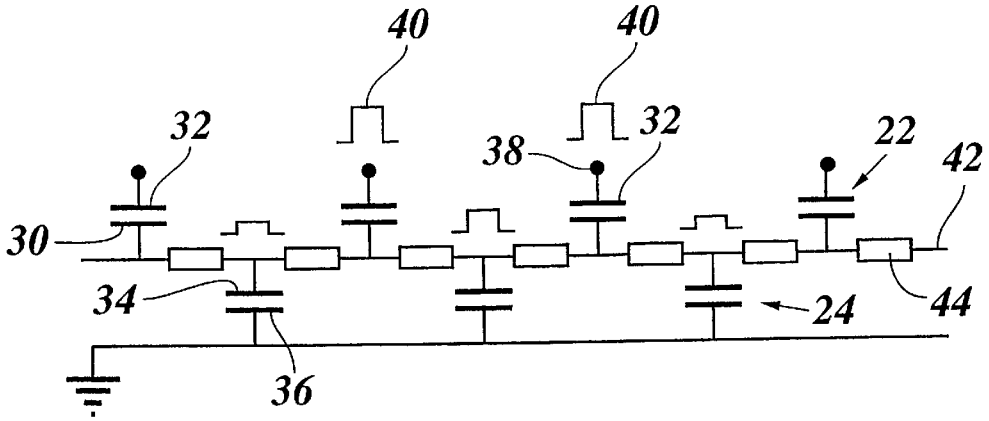
FIG. 2 is a circuit diagram for the actuating device shown in FIG. 1.

Of the four actuator fingers 22 shown in FIG. 2, the first and the fourth are inactive, whereas the second and the third have been activated so as to perform an expansion stroke. Accordingly, the flexible plate 18 has been deflected downwardly into the corresponding ink channels 14, so that the ink contained therein is compressed and ink droplets are expelled from the corresponding nozzles 16. Due to the expansion of the active actuator fingers 22, the backing plate 26 is subject to upwardly directed reaction forces indicated by arrows A in FIG. 1. The backing plate 26 is supported against these reaction forces by the support fingers 24. Since these support fingers are also formed of electromechanical transducers, they may be energized to actively counterbalance the reaction forces of the actuator fingers 22 by performing contraction or expansion strokes opposite to the respective strokes of the actuator fingers. In the example shown in FIG. 1, all three support fingers 24 are energized to perform contraction strokes so as to counterbalance the reaction forces A, by downwardly directed forces B. As a result, the backing plate 26 as a whole will be held stable and will be prevented from vibrating.

Electrically, the first and second electrodes 30, 32 of each actuator finger 22 may be considered as a capacitor. The same applies to the first and second electrodes 34, 36 of the support fingers 24.

FIG. 2 shows the electrical circuit of the actuating device shown in FIG. 1, with the actuator fingers 22 and the support fingers 24 being represented by capacitors. The second electrodes 32 of the actuator fingers 22 are each connected to a terminal 38, so that they may be energized individually by applying a voltage pulse 40 which, as is well known in the art, is generated by a control circuit in accordance with the printing instructions. The second electrodes 36 of the support fingers 24 are grounded. The first electrodes 30 and the first electrodes 34 of the actuator fingers 22 and the support fingers 24 are all interconnected by a common line 42. Ohmic resistances and other impedances (capacitances and inductivities) between the neighboring first electrodes 30, 34 are represented by impedance elements 44. If these impedances are neglected, then all first electrodes 30, 34 of the actuator fingers and support fingers are kept at a common potential which depends upon the balance between the voltage drops at the parallel circuit formed by the various actuator fingers 22 on the one hand and the parallel circuit formed by the various support fingers 24 on the other hand. Thus, the potential of the common line 42 relative to ground increases in proportion with the number of actuator fingers 22 to which energizing pulses 40 are applied, and the potential of the line 42 and hence the potential of the first electrodes 30, 34 will always be between the potential of the second electrodes 32 of the active actuator fingers and ground. The electric field generated between the first and second electrodes 34, 36 of the support fingers 24 will always be opposite to the electric field generated between the first and second electrodes 30, 32 of the actuator fingers 22. Accordingly, if the piezoelectric material of all transducers, i.e. of the actuator fingers 22 and of the support fingers 24, has the same polarisation, an expansion of the actuator fingers 22 will always be accompanied by a contraction of the support fingers 24 and vice versa. In addition, since the first electrodes 30 and 34 of the actuator fingers 22 and the support fingers 24 are disposed on the same level, these electrodes may easily be interconnected by a conductor forming the common line 42.

In practice, the sections of the line 42 interconnecting the neighboring first electrodes 30, 34 will have a certain impedance (resistance, capacitance and inductivity), and this will cause a certain drop or decay of the potential of the line 42 with increasing distance from the actuator finger or fingers that have been energized. Due to a certain flexibility of the backing plate 26, a similar decay will be observed in the reaction forces transmitted from an active actuator finger 22 to the support fingers disposed at increasing distances therefrom. Thus, by appropriately adjusting the impedances of the impedance elements 44, it is possible to match the decay of the potential on the line 42 with the decay of the forces transmitted through the backing plate 26, so that the reaction forces A caused by individual actuator fingers 22 are compensated with high accuracy over the whole length of the array of transducers.

While FIG. 1 shows an alternating arrangement of actuator fingers 22 and support fingers 24, the invention is also applicable to other arrangements, in which the number of actuator fingers is different from that of the support fingers 24.

Since there will only be a negligible amount of coupling or cross talk between actuator fingers 22 and support fingers 24 that are separated by a large distance, it will also be possible to divide the array of transducers 22, 24 into several blocks or groups and to provide a separate line corresponding to the common line 42 in FIG. 2 for each of these groups.

Figure 3:
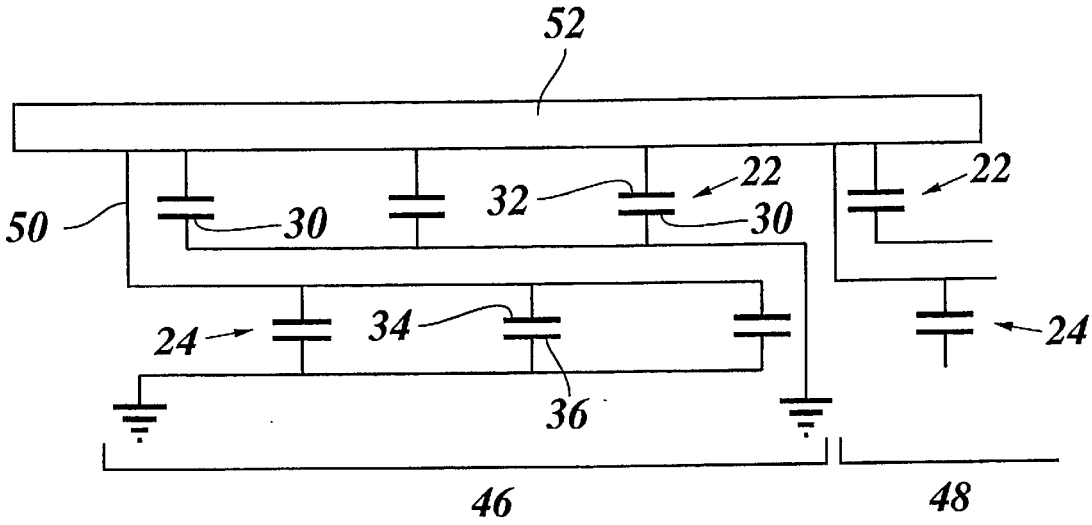
FIG. 3 is a circuit diagram for a modified embodiment of the present invention.

FIG. 3 shows an embodiment in which the array of transducers is subdivided into groups 46, 48 each of which include a certain number of adjacent transducers. In the example shown, the group 46 comprises a total of six transducers, i.e. three actuator fingers 22 and three support fingers 24. Here, the first electrodes 34 of the support fingers 24 are interconnected by a line 50, the potential of which is not floating but is actively controlled by the output of a control circuit 52 which is preferably the same as the control circuit which applies the energizing pulses to the second electrodes 32 of the actuator fingers 22. The first electrodes 30 of the actuator fingers 22 are grounded in this embodiment.

Since all support fingers 24 of one group are commonly controlled by only one output of the control circuit 52, the circuitry and/or the control algorithm of the control circuit 52 may be simplified. Of course, in a practical embodiment, the number of support fingers per group will be significantly larger than three.

Instead of grounding the first electrodes 30 of the actuator fingers 22, as in FIG. 3, it would also be possible to connect these first electrodes 30 to the common line 50. The circuit would then function in a similar way as the circuit shown in FIG. 2, with the only difference that the potential of the common line 50 is not floating but is controlled actively.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An actuating device for a multi-nozzle ink jet printhead which comprises:

a linear array of electromechanical transducers, some of which are configured as actuator fingers operatively associated with the nozzles of the printhead while others are configured as support fingers interposed between the actuator fingers, each electromechanical transducer having a first and a second electrode and is adapted to expand and contract in accordance with a voltage applied between the first and second electrodes, wherein the totality of the transducers define at least one group which includes a plurality of actuator fingers and a plurality of support fingers, and control means operatively associated with each group for applying a voltage, that depends on the number of active actuator fingers in this group, to the first electrodes of all support fingers of the group.

2. The actuating device according to claim 1, wherein all the transducers of the linear array form only a single group.

3. The actuating device according to claim 1, wherein the second electrodes of the actuator fingers are connected to be energized individually by energizing pulses, and the control means includes a common line which is maintained floating and interconnects the first electrodes of all actuator fingers and support fingers of the group.

4. The actuating device according to claim 3, wherein the control means includes impedance elements intervening between each pair of first electrodes of neighboring actuator fingers and support fingers.

5. The actuating device according to claim 1, wherein the control means includes a control circuit having one output for each group of transducers, said output being connected to the first electrodes of all support fingers of the group through a common line.

* * * * *